US007264393B2

(12) United States Patent
Lin

(10) Patent No.: US 7,264,393 B2
(45) Date of Patent: Sep. 4, 2007

(54) FOLDABLE HALF SOCKETS TO FORM COMPLETE SOCKETS FOR CHRISTMAS LIGHTS

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 251 days.

(21) Appl. No.: 11/148,240

(22) Filed: Jun. 9, 2005

(65) Prior Publication Data

US 2006/0264105 A1 Nov. 23, 2006

(30) Foreign Application Priority Data

May 19, 2005 (CN) ..... 2005 2 0019045

(51) Int. Cl.
*H01R 33/00* (2006.01)

(52) U.S. Cl. ..... 362/654; 362/252; 362/249; 362/806

(58) Field of Classification Search ..... 362/654, 362/252, 809, 249; 439/505, 699.2, 336
See application file for complete search history.

(56) References Cited

U.S. PATENT DOCUMENTS 1,510,230 A * 9/1924 Johnston ..... 362/121
2,172,757 A * 9/1939 Pollock ..... 362/252
4,783,726 A * 11/1988 Wang ..... 362/252
5,430,626 A * 7/1995 Leffel ..... 362/121
7,001,062 B2 * 2/2006 Lin ..... 362/654
2006/0164835 A1 * 7/2006 Sidwell et al. ..... 362/249

* cited by examiner

*Primary Examiner*—Sandra O'Shea
*Assistant Examiner*—Zahra I. Bennett

(57) ABSTRACT

A foldable half sockets to form complete sockets for Christmas lights includes a V-shaped double sockets fold away of a pair of V-shaped half sockets in opposing symmetrical arrangement connected by a pair of thin membranes and avoid therebetwen. The sockets each has a pair of longitudinal slits, a pair of indentations in their lower peripheries for passing through a pair of electric wires each with a single contact plate on the top. A V-shaped groove formed in an inner periphery of the sockets for engaging within a V-shaped common contact plate. When the half socket is folded away, a pair of sleeves wrapped thereon. A pair of lamps insert in the sockets each has a longitudinal flat extension inserted into the longitudinal slits and a pair of lead-in wires respectively engaged with the common contact plate and a single contacts respectively.

6 Claims, 10 Drawing Sheets

FOLDABLE HALF SOCKETS TO FORM COMPLETE SOCKETS FOR CHRISTMAS LIGHTS

BACKGROUND OF THE INVENTION

The present invention relates to Christmas lights and more particularly to a foldable half sockets to form complete sockets for Christmas lights which is capable of making varied shapes.

Prior art socket 1 (as shown in FIGS. 1 and 2) includes an integrated socket 2, a bulb 3 in the top of a base 4 with a pair of lead-in wires attached to the base 4, a pair of copper plate connected to a pair of electric wires respectively. However, this type of Christmas light is looked too dull without any variation.

Although the producers try to make combined double socket in order to present some variation, but could not integrally configurated due to that the mold is always difficult to rise. So most of them to make two individual sockets. Then combine them together or make stepwise combined sockets, nevertheless, whatever they do. Thy couldn't solve the problem that the assembly of the other parts such as the contact plate and the lamps is not accurately positioned. Nowadays, every one still carries on the study. But no body gets break through.

SUMMARY OF THE PRESENT INVENTION

The present invention has a main object to provide a foldable half sockets to form complete sockets for Christmas lights which is capable of making V-shaped, W-shaped or X-shaped combined sockets. Besides, they are easy to assembly and the contact plates provide excellent conductivity.

Accordingly, the foldable half sockets to form complete sockets for Christmas lights of the present invention comprises generally a X-shaped configuration which is integrally molded into two pairs of symmetrical half sockets. Each pair of relevant half sockets having identical inner structure. Their connecting ends have the voids and thin membranes which facilitates them to fold into a complete V-shaped combined sockets. Each of the sockets has a sleeve as a reinforcement respectively wrapped on their body, other necessary parts such as the contact plates, the electric wires, and the lamps are all of the conventional which will describe in the following content.

The present invention will become more fully understood by reference to the following detailed description thereof when read in conjunction with the attached drawings.

DETAILED DESCRIPTION OF THE PREFERRED EMBODIMENT

Figure 1:
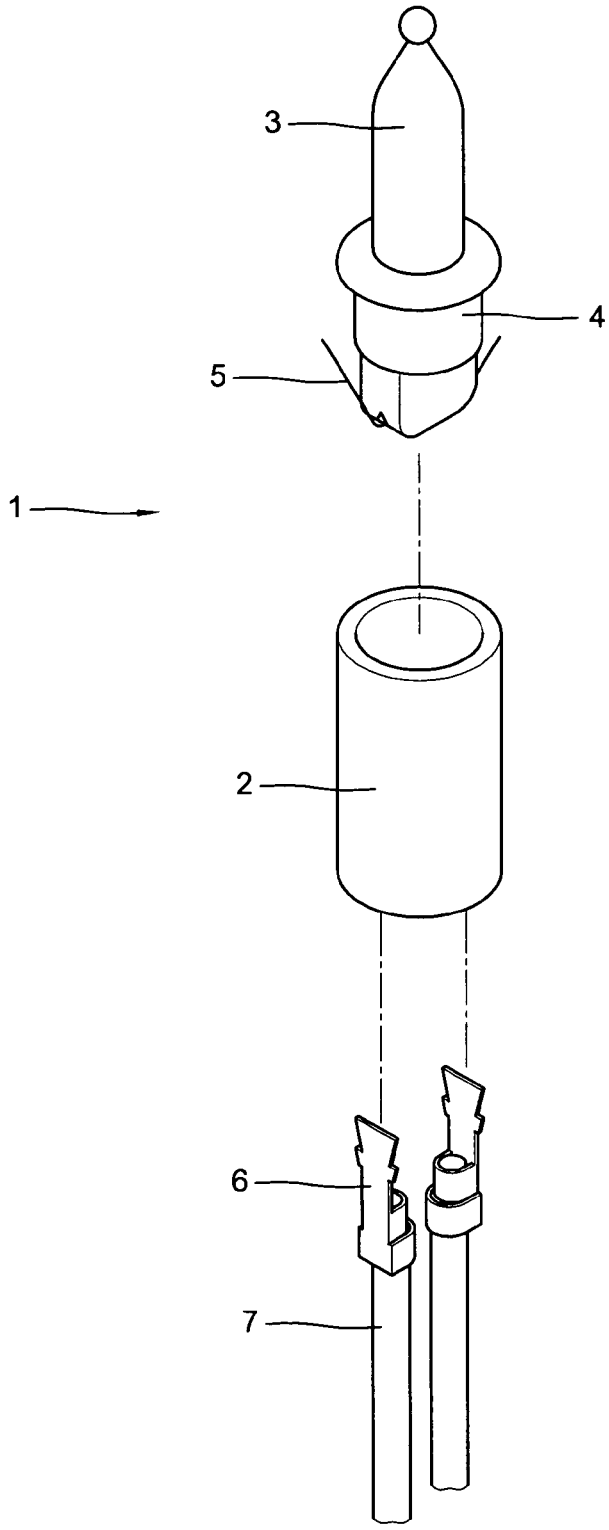
FIG.1 Prior Art
FIG. 1 is an exploded perspective view of a prior art Christmas light.
Figure 2:
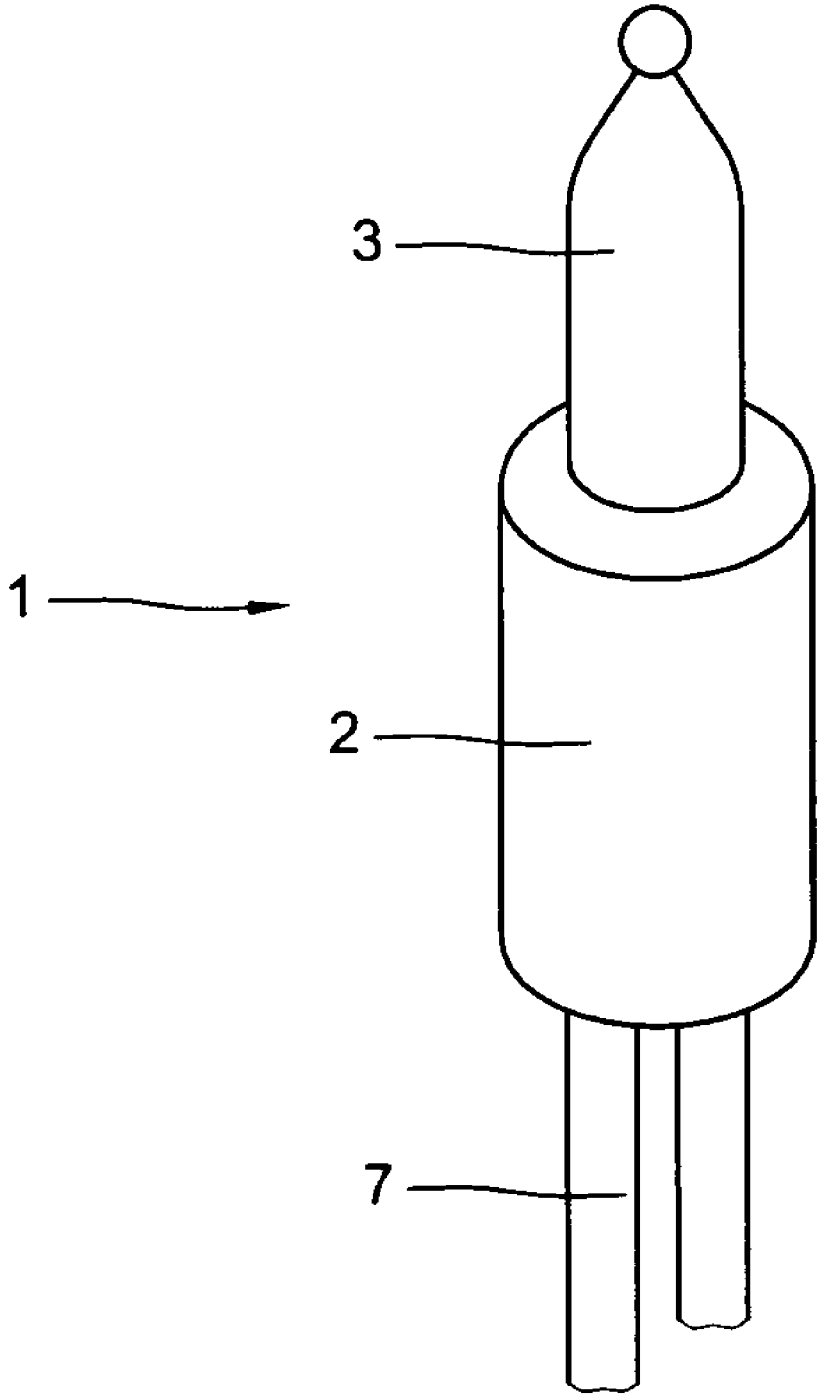
FIG.2 Prior Art
FIG. 2 is a perspective view to show the assembly of FIG. 1.
Figure 3:
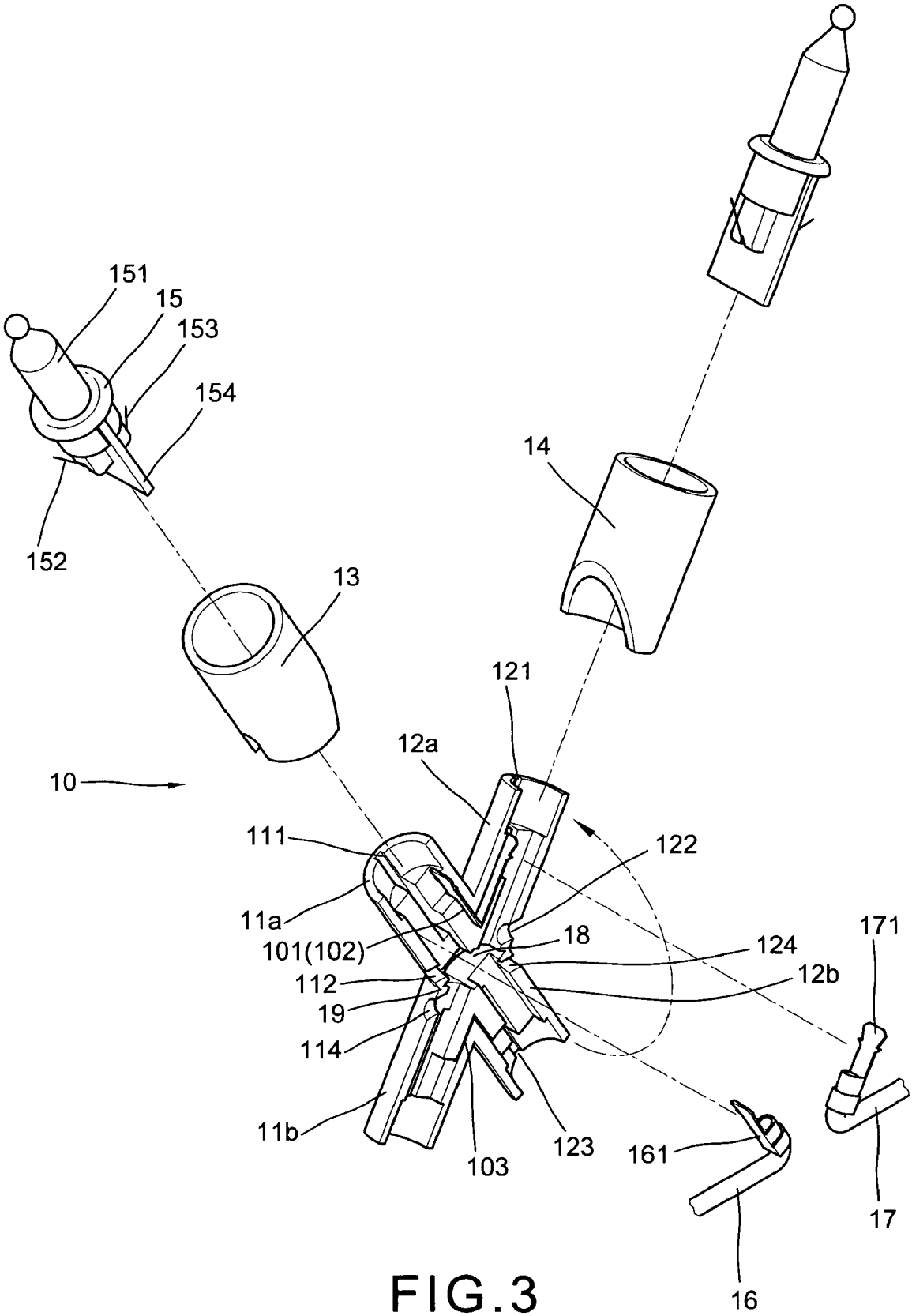
FIG. 3 is an exploded perspective view to show the first embodiment of the foldable sockets according to the present invention.

With reference to FIGS. 3, 4, 5 and 6 of the drawings, the first embodiment of the foldable half sockets to form complete sockets of the present invention comprises a main body 10, a pair of sleeves 13 and 14, a pair of lamps 15 and a pair of electric wires 16 each having a contact plate 161 and 171. The main body 10 is of a X-shaped configuration including two pair of corresponding half sockets which are integrally molded, all of which are separated into two upper halves 11*a* and 12*a* and two lower halves 11*b* and 12*b*, between them is a void 18 at center and a pair of thin membranes 19 so that they are capable of folding away.

Figure 4:
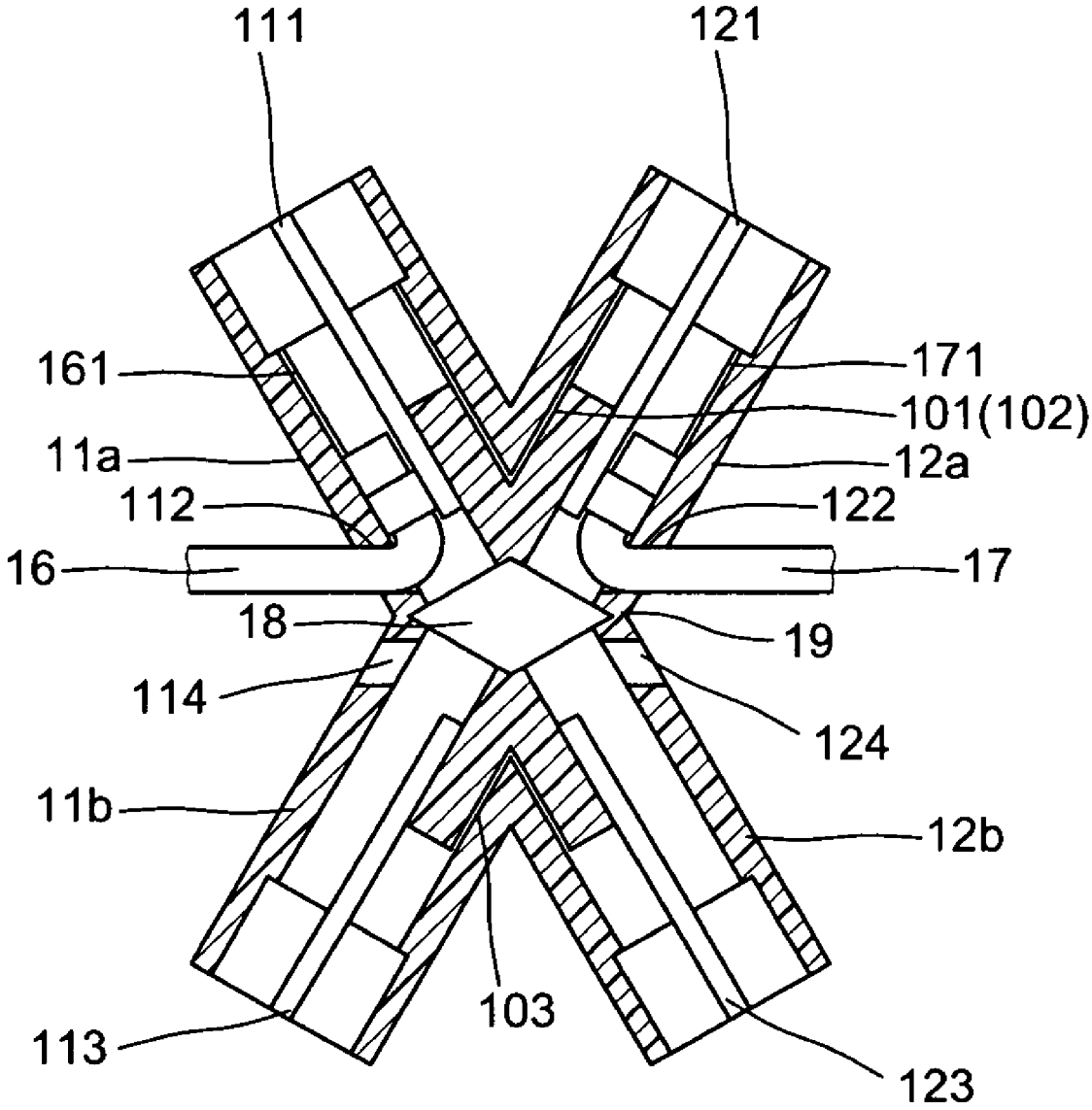
FIG. 4 is a sectional view where the X-shaped halves are ready to fold away.
Figure 5:
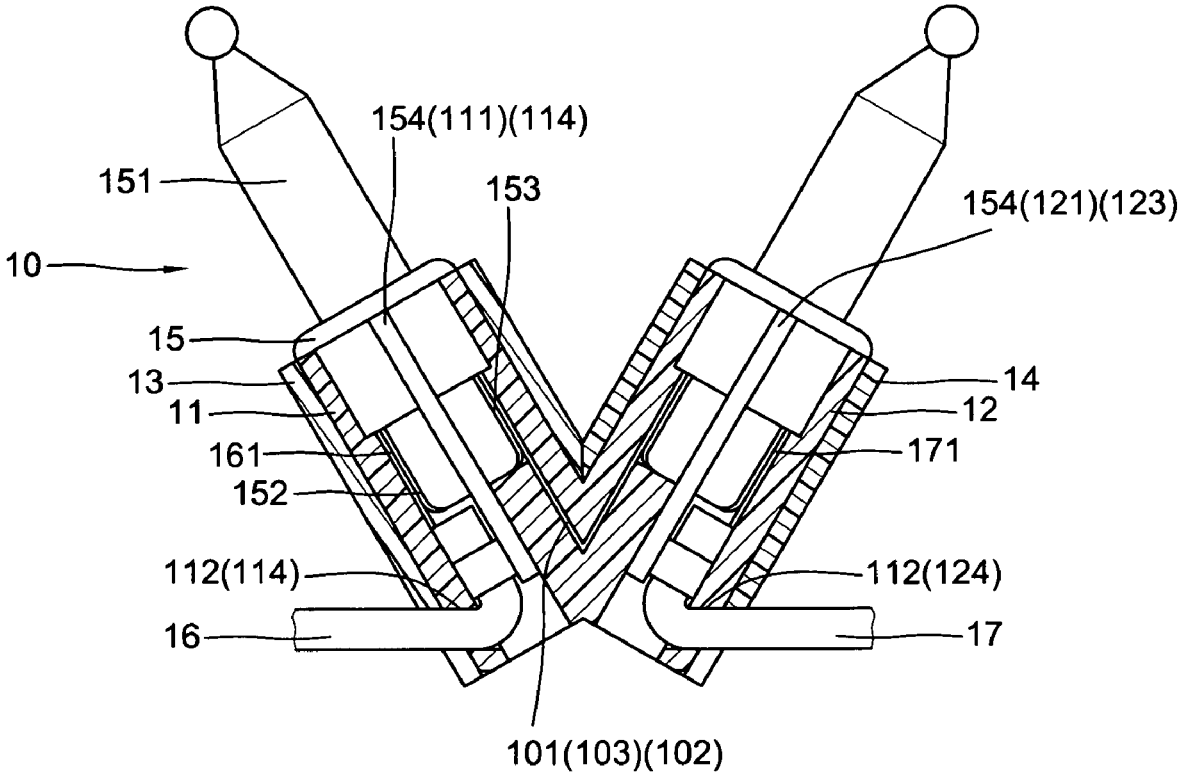
FIG. 5 is a sectional view to show the assembly of the first embodiment.
Figure 6:
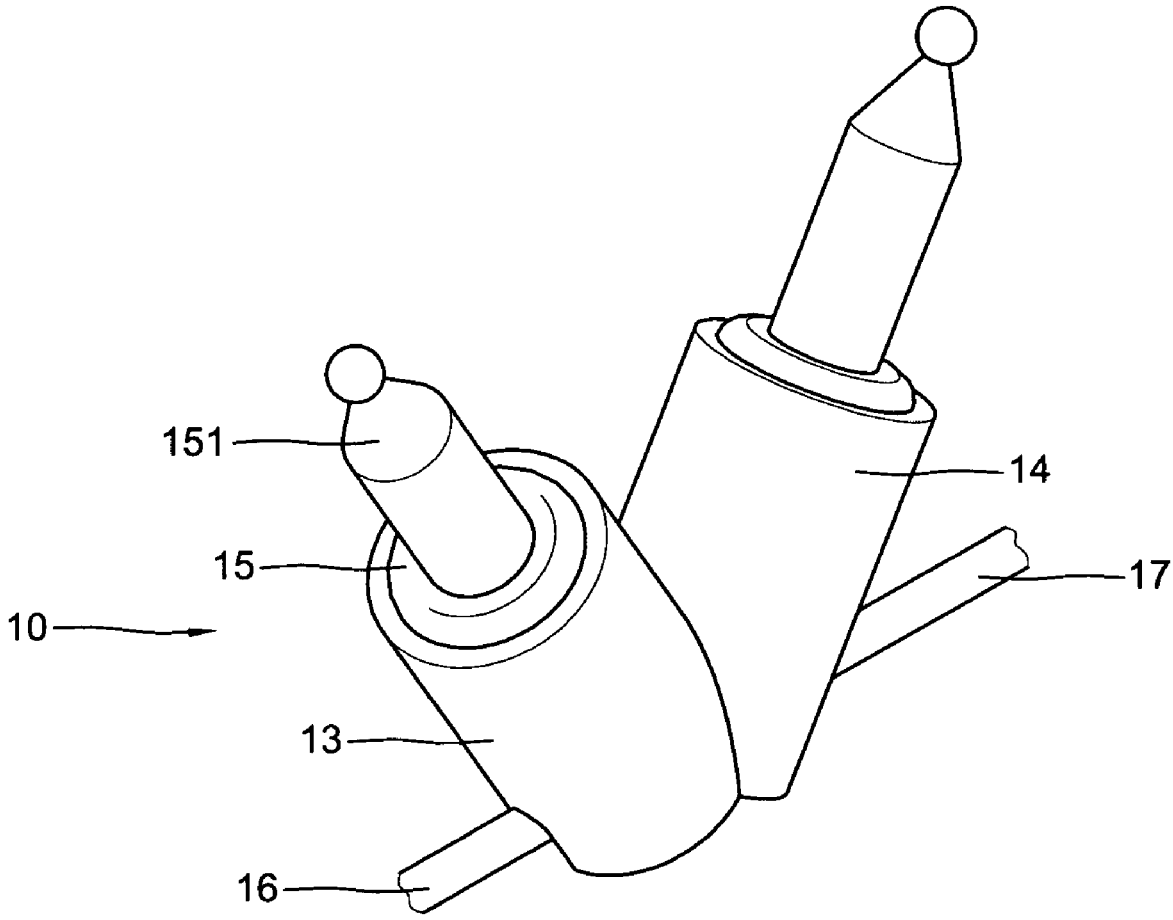
FIG. 6 is a perspectively of FIG. 5.

The upper half 11*a* has an inner periphery for engaging the contact plate 161 (or make a groove to receive the plate 161), whereas the contact plate 171, a V-shaped groove 101 formed in the neighboring inner periphery of the upper halves 11*a* and 12*a*, for engagement of a V-shaped common contact plate 102. Both of the upper halves 11*a* and 12*a* having a longitudinal positioning slit 111 and 121 formed in a central inner periphery and an indentation 112 and 122 in lower outer ends for permitting the electric wires 16 and 17 to extend outward. The lower halves 11*b* and 12*b* each has also a positioning slit 113 and 123 (as shown in FIG. 4) made in registry with the positioning slits 111 and 121, an indentation 114 and 124 made in registry with the indentations 112 and 122, a V-shaped groove 103 in the neighboring inner periphery made in registry with the V-shaped groove 101. So that when the upper and lower halves 11*a*, 11*b*, 12*a* and 12*b* are folded away, every details are engaged each other to achieve a complete V-shaped combined sockets. Meanwhile, the sleeves 13 and 14 are respectively wrapped onto the sockets for reinforcement purpose and each having a large oblique indentation in inner side of the lower periphery and a small indentation in outer side of the lower periphery engaged with the indentations 112 and 122 of the sockets. The pair of lamps 15 respectively insert into the upper rim of the sockets each having a base, a bulb 151 in the top of the base, a wider longitudinal positioning extension 154 inserted into the longitudinal positioning slits 111 and 121, 113 and 123, and a pair of lead-in wires attached on the base respectively engaged with contact plates 161 and 171 and the V-shaped common contact plate 102. The providing of the extension 154 in cooperation with the longitudinal slits 111 (113) and 121 (123) insures the lamp more secure in the sockets.

This embodiment more facilitates in the integral configuration, readily to assembly, good conductivity, and the enable to make a V-shaped combination which is previously not to do. There feature is helpful to mass production and the result must be uniformly beautiful.

Figure 7:
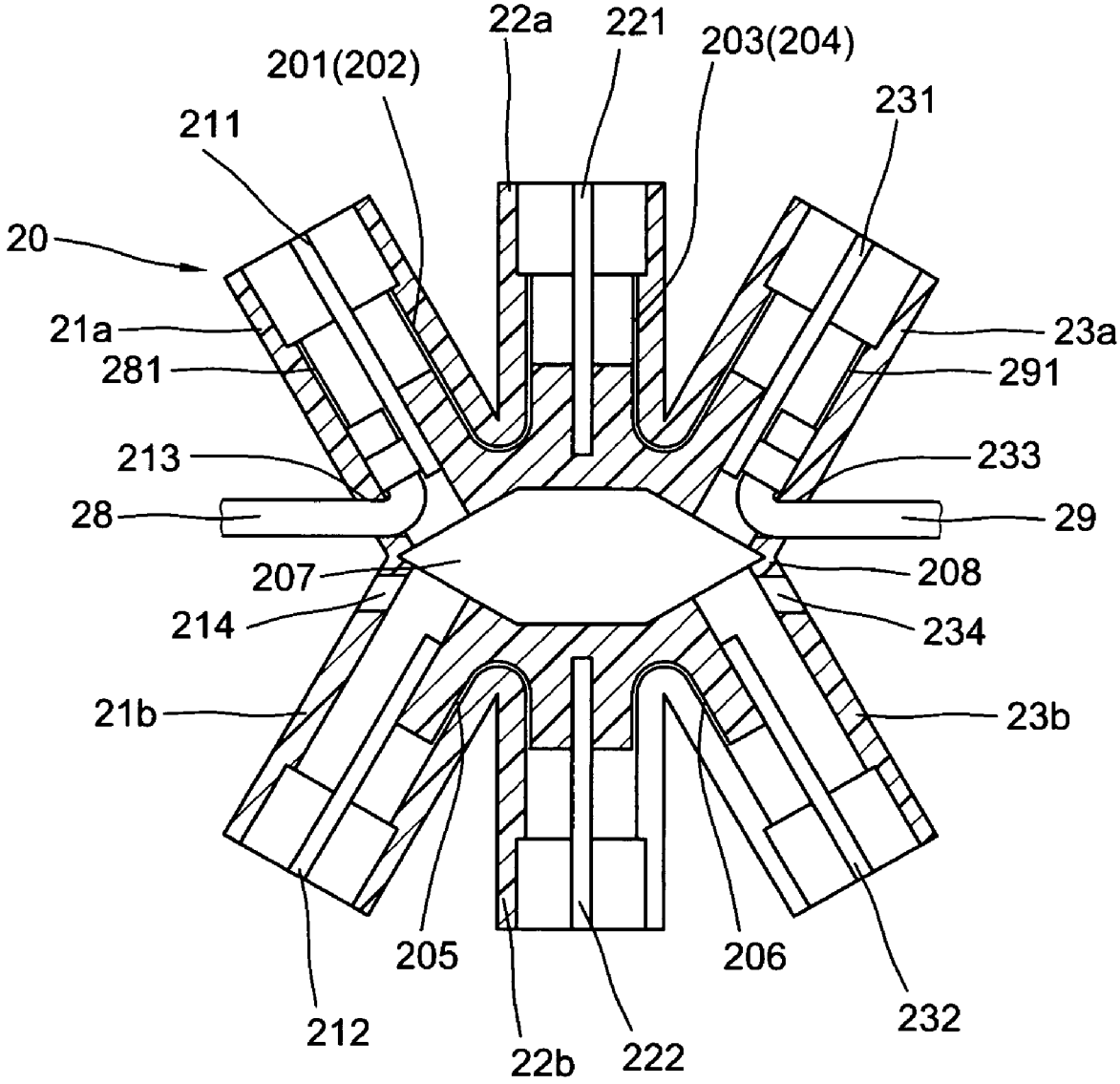
FIG. 7 is a sectional view to show a second embodiment of the present invention where the six halves are ready to fold away.
Figure 8:
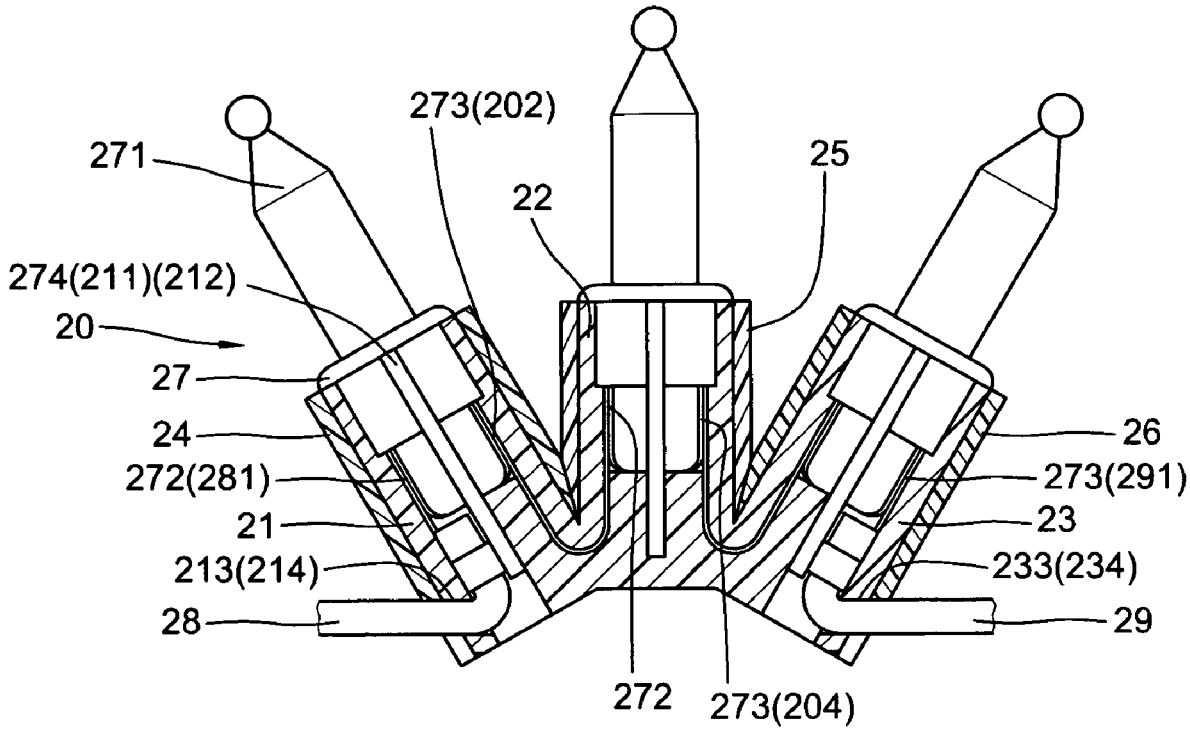
FIG. 8 is a sectional view to show the assembly of FIG. 7.

Referring to FIGS. 7 and 8, a second embodiment 20 of the foldable half socket of the present invention is provided. This embodiment comprises three bottom combined sockets which is structurally and functionally most similar to that of the first embodiment as described in FIGS. 3 to 6, the above discussions are applicable in the most instances and which is integrally molded three upper halves 21*a*, 22*a* and 23*a* and three lower halves 21*b*, 22*b* and 23*b* in an opposing symmetrical arrangement, their bottoms are connected by a pair of thin membranes 208 and left a hexagon void therebetween. Both the upper and lower halves have a longitudinal slit 211, 221, 231, 212, 222 and 232 in a central inner periphery. The left and right ones of the upper and lower halves have an indentation 213, 233, 214 and 234. Each conjunction between adjacent halves have in their inner peripheries a V-shaped groove 201, 203, 205 and 206 for engagement of a pair of V-shaped common contact plate 202 and 204, a pair of electric wires 28 and 29 each has a contact plate 281 and 291 engaged in an outer inner periphery of the upper halves 21*a* and 23*a*, the electric wires 18 and 19 are bent over and extruded from the indentations 213 and 233 respectively. When the lower halves 21*b*, 22*b* and 23*b* are folded to their corresponding upper halves 21*a*, 22*a* and 23*a*, a complete combined triple sockets 20 is therefore achieved (as shown in FIG. 8). Three sleeves 24, 25 and 26 respectively wrapped onto the three socket. Wherein, the sleeve 24 has the structure equal to the sleeve 26 and each of which has a large oblique indentation above the bottom of the inner lower periphery, a through hole above the bottom of the outer lower periphery engaged with indentations 213 (214) and 233 (234). The central sleeve 25 is shorter than the others. Three identical lamps 27 respectively inserted into each of the three sockets and each has a base, a bulb 271 in the top of the base, a longitudinal flat extension 274 projected downward from the center of the base and a pair of lead-in wires 272 and 273 attached to the opposing outer peripheries of the base and engaged with the V-shaped common contact plate 202 or 204 and a contact plate 281 or 291. However, the lead-in wires in the central socket engaged with both V-shaped common contact plate 202 and 204. So that an electric circuit is therefore accomplished in the three sockets.

Figure 9:
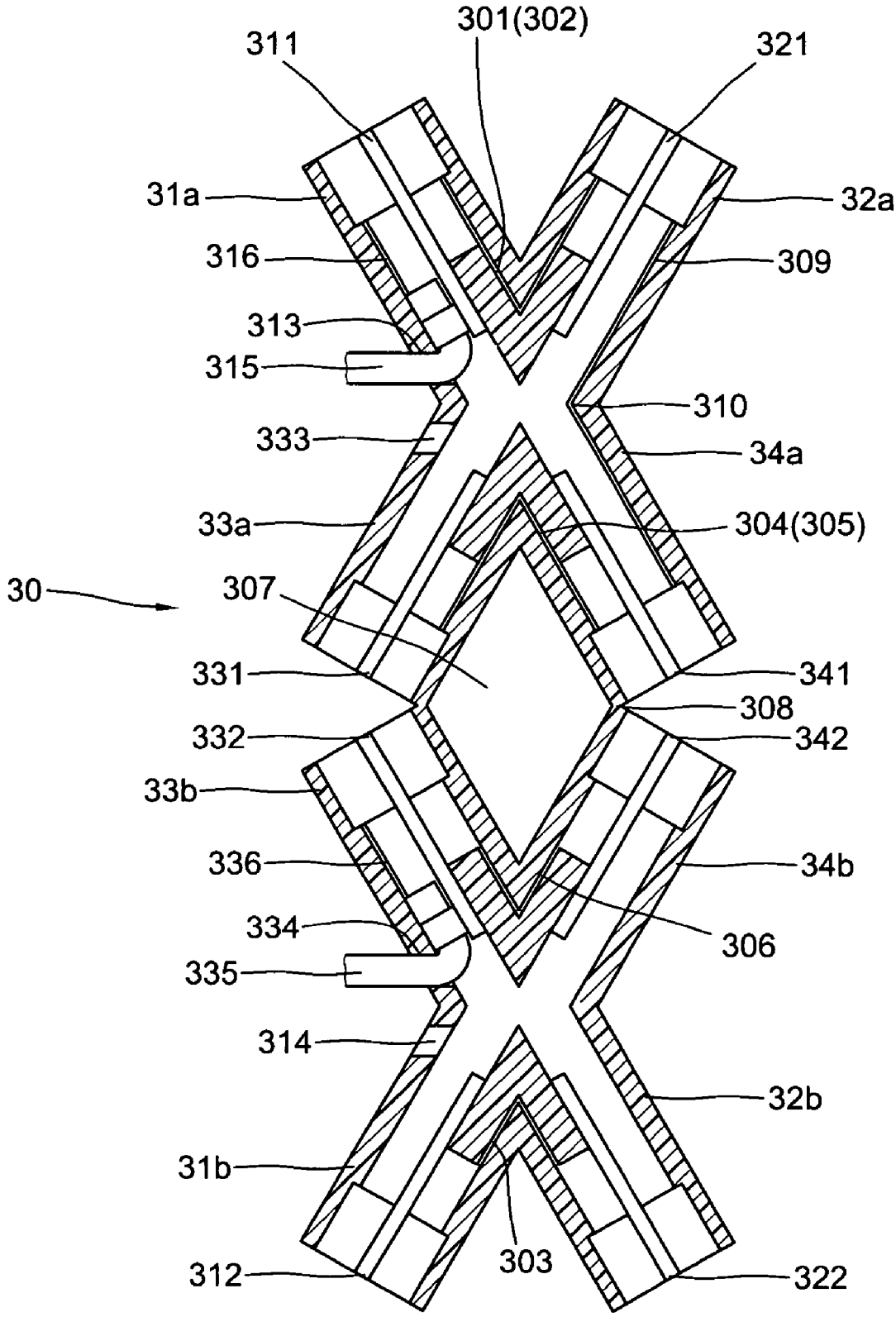
FIG. 9 is a sectional view to show a third embodiment of the foldable half sockets of the present invention.
Figure 10:
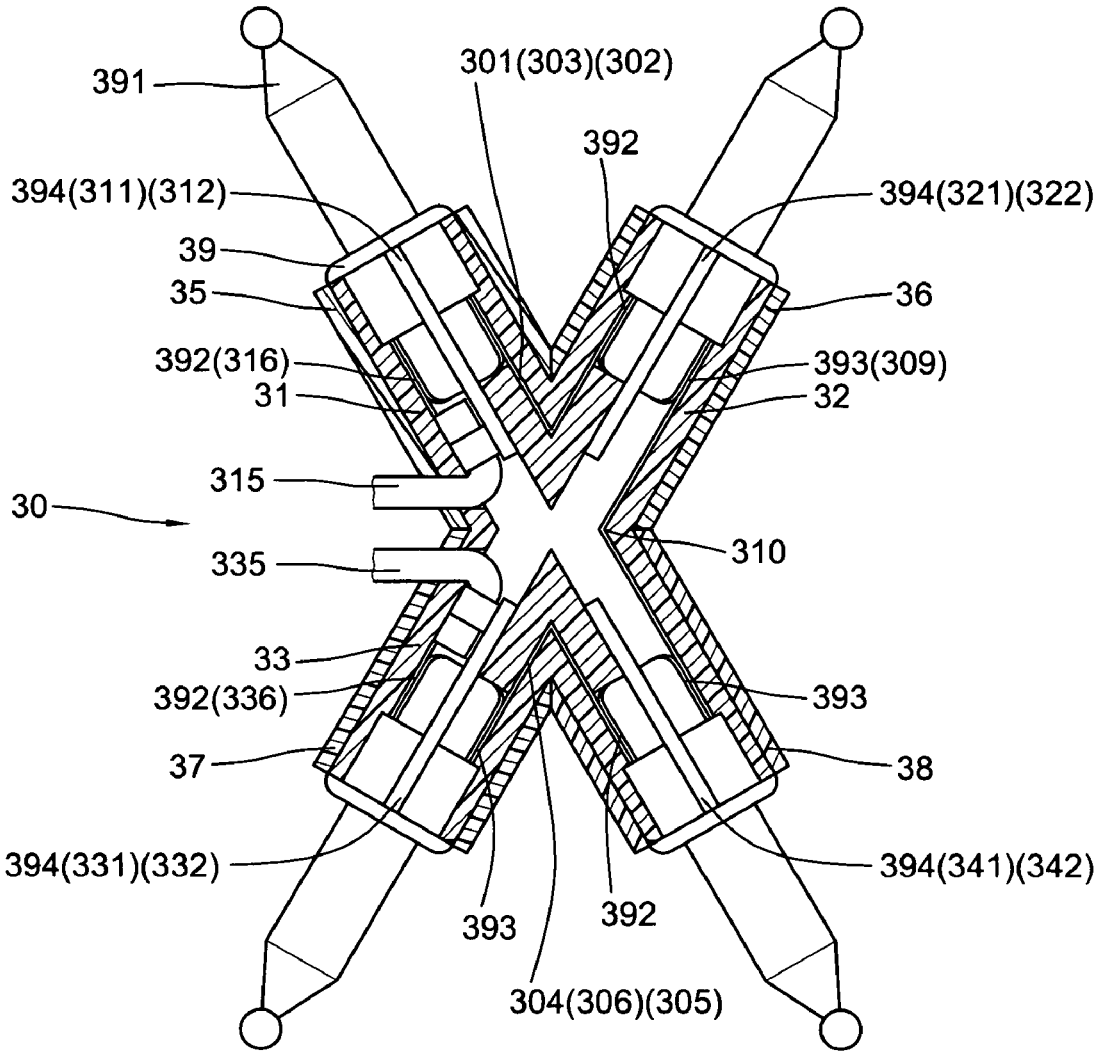
FIG. 10 is a sectional view to show the assembly of FIG. 9.

Referring FIGS. 9 and 10 of the drawings, a third embodiment of the foldable halve sockets of the present invention is provided. Although this embodiment has been made a shape variation, But basically the structure and function of the individual socket is most similar to that of the above embodiment as described in FIGS. 3 to 8 and the above discussions are applicable in the most instances, too. This embodiment present a X-shaped combination of the sockets 30. So it has to integrally mold an upper halves and a corresponding lower halves connected by a pair of thin membranes 308 and forming a parallelogram void 307 thereinbetween. The upper halves as well as the lower halves each includes four half sockets 31*a*, 32*a* 33*a*, 34*a* and 31*b*, 32*b*, 33*b*, 34*b* to form a double X-shaped configuration. Each of the those half sockets has a longitudinal positioning slit 311, 321, 331, 341, 321, 322, 332 and 342 in the central inner periphery. The half socket 31*a* has an indentation for passing through an electric wire 315 which has a single contact plate 316 on the top engaged with an outer inner periphery of the half socket 31*a*. Whereas, the half socket 33*b* has also an indentation 334 in a lower outer periphery for passing through an electric wire 335 which has a single contact plate 336 engaged with the outer inner periphery of the half socket 33*b*. Each conjunction between the half sockets 31*a* and 32*a*, 33*a* and 34*a*, 33*b* and 34*b*, and 31*b* and 32*b* has a V-shaped groove 301, 304, 303 and 306 in their inner peripheries for engaging within a pair of V-shaped common contact plates 302 and 305. The conjunction between the half sockets 32*a* and 34*a* has a large V-shaped groove 310 for engage within a large V-shaped common contact plate 309. When the lower halves 31*b*, 32*b*, 33*b* and 34*b* are folded on the upper halves 31*a*, 32*a*, 33*a* and 34*a* to achieve four complete sockets, four sleeves 35, 36, 37 and 38 for reinforcement suppose are respectively wrapped on the sockets. All the sleeves 35, 36, 37 and 38 have a deep outer peripheries and the shallow inner peripheries, where the sleeve 35 and 37 each has a through hole in the lower portion of the outer periphery engaged with the indentations 313 and 334. Four identical lamps 39 respectively inserted into the four sockets and each has a bulb 391 in the top of the base, a flat longitudinal extension 394 projected downward from the center of the base and respectively engaged with the longitudinal slits 311 and 312, 321 and 322, 331 and 332, and 341 and 342 of the four sockets, and a pair of lead-in wires 392 and 393 attached to the opposing outer peripheries of the base respectively engaged with the single contact plates 316 and 336 and the V-shaped common contact plates 302, 305 and 309 (as shown in FIG. 10), an electric circuit is therefore accomplished in the X-shaped arrangement four sockets.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A half sockets to form complete sockets for Christmas lights comprising:

a V-shaped combined socket which is formed by a X-shaped main body including two upper V-shaped half sockets and two lower corresponding half socket in opposing symmetrical arrangement, and connected by a pair of thin membranes on two lateral sides and a void positioned therebetween, said sockets each having a pair of longitudinal slits in opposing inner peripheries, a single contact plate from a first and second electric wires engaged in an inner periphery perpendicular to the slits, said electric wires eventually extruded to outside of said sockets through a pair of indentations in a periphery above bottom of said sockets, a V-shaped groove formed in a conjunction between said sockets in neighboring inner periphery respectively facing the single contact plate for engaging a V-shaped common contact plate;

a pair of sleeves wrapped on the sockets respectively and each having a large oblique indentation in inner periphery and a through hole in the outer periphery above bottom thereof engaged with the indentations of the sockets;

a pair of identical lamps respectively inserted into upper rim of the two sockets each having a base, a bulb in top of the base, a flat longitudinal plate projected downward from center of the base, engaged with said pair of longitudinal slits of each of the sockets and a pair of lead-in wires attached to lateral cuter side of the base, respectively engaged with the common contact plate and the single contact plates respectively;

whereby, an electric circuit is therefore established in the sockets.

2. The foldable half socket to form complete sockets as recited in claim 1, wherein said X-shaped configuration of half sockets is integrally molded.

3. A foldable half socket to form complete sockets comprising:

a combined triple sockets which are folded by a configuration containing three upper halves and three lower corresponding halves in an opposing symmetrical arrangement and connect on their bottoms by a pair of thin membranes and a hexagonal void positioned therebetween, said sockets each having a pair longitudinal slit in opposing inner peripheries, a single contact plate from a pair of first and second electric wires engaged in an inner periphery of the outmost sockets perpendicular to the longitudinal slits, a pair V-shaped grooves formed in inner peripheries at the conjunctions between left and middle sockets and between the middle socket and the right socket for engaging within a pair of V-shaped common contact plates, an indentation form in outer periphery of the outmost sockets above bottom thereof for permitting said electric wires to extrude out of said sockets;

three sleeves respectively wrapped on the foldaway sockets, wherein the middle ones is shorter than the others and having a pair of large oblique indentations in opposing peripheries above bottom, other two outmost sleeves each having large oblique indentation engaged with that of the middle ones and a through hole in a outer periphery engageable with the indentations of the two outmost sockets;

three identical lamps respectively inserted into upper rim of said three sockets and each having a base, a bulb in top of the base, a longitudinal extension projected downward from middle of the base respectively engaged with said pair of longitudinal slits and a pair of lead-in wires attached to outer lateral sides of the base respectively engaged with a common contact plate and a single contact plate, wherein the lead-in wires of the middle lamp engaged both of the common contact plates;

whereby, an electric circuit is therefore established in the triple combined sockets.

4. The foldable half sockets to form complete sockets as recited in claim 3, wherein said six half socket configuration is integrally molded.

5. A foldable half sockets to form complete sockets for Christmas lights comprising:

four sockets to connect their bottoms to form a X-shaped combined sockets which is folded by a double X-shaped configuration of half socket and connected on their relative ends by a pair of thin membranes and a parallelogram void positioned therebetween, said sockets each having a pair of longitudinal slit in opposing inner peripheries, two short V-shaped grooves respectively form in inner peripheries aside middle conjunctions for engaging a pair of short V-shaped common contact plates, a large V-shaped groove in an inner peripheries aside a right conjunction for engaging within a large V-shaped common contact plate, a first electric wire inserted into a first half socket in upper portion via through hole and having single contact plate engaged in an inner periphery perpendicular to the longitudinal slits, a second electric wire inserted into a first half socket at lower position via another through hole and having single contact plate on top engaged with an inner periphery perpendicular to the longitudinal slit, When the lower portion of half sockets foldaway to the upper portion of the half sockets, a X-shaped complete sockets being formed;

four identical sleeves of identical shaped wrapped on four complete sockets each having a long outer periphery and a oblique inner periphery engaged with one another, wherein two left sleeves each having through hole in an outer periphery engaged with the through holes of the sockets;

four identical lamps inserted into the rim of the sockets respectively and each having a base, a bulb in top of the base, a flat longitudinal extension projected downward from center of the base respectively engaged within the pair of the longitudinal slits and a pair of lead-in wires attached to outer lateral side of the base respectively engaged with the common contact plates, wherein, the lead-in wires in the first and third sockets each engaged with a common contact plate and a single contact plate;

whereby, an electric circuit is therefore established in side the combined X-shaped sockets.

6. The foldable half sockets to form complete sockets as recited in claim 5, wherein said double X-shaped half sockets are integrally molded.

* * * * *